US011407551B2

(12) United States Patent
Podpecan

(10) Patent No.: US 11,407,551 B2
(45) Date of Patent: Aug. 9, 2022

(54) CONTAINER, SYSTEM, AND METHOD FOR PROVIDING A CONTAINER WITH A HANDLE

(71) Applicant: BRAANDCO F.Z.E., Sharjah (AE)

(72) Inventor: Branko Podpecan, Dubai (AE)

(73) Assignee: BRAANDCO F.Z.E., Sharjah (AE)

( * ) Notice: Subject to any disclaimer, the term of this patent is extended or adjusted under 35 U.S.C. 154(b) by 63 days.

(21) Appl. No.: 16/384,233

(22) Filed: Apr. 15, 2019

(65) Prior Publication Data

US 2019/0352043 A1 Nov. 21, 2019

(30) Foreign Application Priority Data

May 16, 2018 (EP) ..... 18172694

(51) Int. Cl.
*B65D 5/46* (2006.01)
*B65D 5/468* (2006.01)
*B65D 5/478* (2006.01)

(52) U.S. Cl.
CPC ..... *B65D 5/4608* (2013.01); *B65D 5/46056* (2013.01); *B65D 5/46072* (2013.01)

(58) Field of Classification Search
CPC ..... B65D 5/46–46064; B65D 33/12
USPC ..... 229/117.09–117.12, 117.19–117.26, 229/125.22, 125.38; 383/13, 26–27, 14, 383/17–20
See application file for complete search history.

(56) References Cited

U.S. PATENT DOCUMENTS 577,416 A * 2/1897 Brown ..... B65D 5/36 229/117.02
2,011,407 A * 8/1935 Hirsch ..... B65D 75/56 383/20
2,260,951 A * 10/1941 Mulnix ..... B65D 5/46056 229/117.19
2,741,420 A 4/1956 Bodard
2,771,237 A * 11/1956 Philipson ..... B65D 67/00 229/125.22
3,149,367 A * 9/1964 Dills ..... A45F 5/1046 294/171
3,283,993 A * 11/1966 McLean ..... B65D 33/12 383/20
3,394,868 A 7/1968 Speer
4,813,792 A * 3/1989 Belmont ..... B65D 33/28 383/13

(Continued)

FOREIGN PATENT DOCUMENTS

EP 0 947 432 A1 10/1999
EP 0947432 A1 * 10/1999 ..... B65D 5/46008
FR 2709113 A1 * 2/1995 ..... B29D 29/00

*Primary Examiner* — Nathan J Newhouse
*Assistant Examiner* — Phillip D Schmidt
(74) *Attorney, Agent, or Firm* — Seed Intellectual Property Law Group LLP

(57) ABSTRACT

A container comprises a connecting means, which forms an integral part of the container or is detachably attached to the container. In an unpacked state of the container, at least a portion of the connecting means is detached from the container and at least partially spans at least a part of a circumference of the container. In the unpacked state of the container, the connecting means provides a handle suitable for being supported by a carrier. A system comprising a respective container and a method for providing a container with a handle are described.

18 Claims, 9 Drawing Sheets

(56) References Cited

U.S. PATENT DOCUMENTS 6,113,267 A * 9/2000 Roy ..... A45C 13/26
206/223
9,598,202 B2 * 3/2017 Oliveira ..... B65D 5/0227

* cited by examiner

CONTAINER, SYSTEM, AND METHOD FOR PROVIDING A CONTAINER WITH A HANDLE

BACKGROUND

Technical Field

The present disclosure pertains to containers for transportation of goods.

Description of the Related Art

There is a variety of consumer goods offered to consumers. Consumer goods may include, without being limited to, material products that a consumer can use, consume, store, resell or otherwise dispose. The consumer may physically visit a point of sale, such as a retailer, outlet, or a private seller, and purchase an item of his choice. Additionally or alternatively, the consumer may order the item remotely, e.g., via the Internet, by telephone, via telefax, via post, by verbal or written agreements or messages, or any other proper means available.

The purchased item usually comes stored in a package. In some cases, the purchased item is made portable by being packed in a transport means, such as a plastic bag, for the transport. For this purpose, the seller at the point of sale needs to extra provide the respective transport means including, for example, provision, acquisition and storage of the transport means and making it available at the point of sale. Using the extra transport means, the purchase process in addition is expanded by the process of packing the item into the transport means, leading to increased process time, cost and consumed energy.

The transport means has fulfilled its purpose upon arrival of the item at the destination (e.g., at the consumer) and is then often disposed as waste. The increasing waste production poses a threat in environmental, economic and social terms. In particular, the transport means usually is made of synthetic materials, such as polyethylene, polypropylene, or other polymer based materials. These materials often are non-biodegradable or non-compostable and endure many years until decomposition, thereby even further increasing the amount of waste to be managed.

Therefore, there is a need for a device and/or a method allowing for transporting goods that address the above indicated problems.

BRIEF SUMMARY AND INITIAL DISCLOSURE

According to an aspect of the disclosure, a container is provided. The container comprises a connecting means. The connecting means forms an integral part of the container or is detachably attached to the container. In an unpacked state of the container, at least a portion of the connecting means is detached from the container and at least partially spans at least a part of a circumference of the container. In the unpacked state of the container, the connecting means provides a handle suitable for being supported by a carrier.

The container may be suitable for enclosing physical items, which may be, for instance, consumer goods. The physical items may comprise parts in any state of matter. Examples for the physical items that may be contained by the container include one or more of consumer electronics, cloths, footwear, food, liquids, accessories, furniture, or any items of daily use. In some examples, the physical items are provided in a package. Accordingly, the container may have at least one hollow interior space, cavity, or a compartment to receive and/or store one or more physical items.

In some examples, the container may secure the physical item inside the container in a manner that the physical item does not escape the container due to the gravity or due to movements. In some examples, the interior space of the container is substantially closed in all or at least most of the spatial directions to ascertain a secure storage of the physical item inside.

In some examples, the interior space of the container may be made accessible from the outside to insert a physical item into the container or to remove a stored physical item out of the container. For this purpose, the container may comprise an opening mechanism. For example, the container may be provided as multiple separable parts, such as a body opened to one side and a corresponding cover lid that may be separated from one another for accessing the interior space of the container and/or joined to one another in order to secure the item inside. Alternatively or additionally, the container may comprise an openable part that is integral with a body of the container and is movable between an open position and a close position. The transition between the open and close positions may be performed, for instance, by sliding or pivoting the openable part.

The container may have various shapes. Examples for the shape of at least a part of the container include, without being limited to, a polyhedron shape, block shape, box shape, cylindrical shape, spherical shape, oval shape, or any combination thereof. Moreover, the container may have a modified shape based on one of the aforementioned shapes or a combination thereof by, for instance, adding one or more geometrical features or omitting one or more portions.

A packed state of the container may include that the connecting means is stored in, on, at, or at least close to the container. Alternatively or additionally, the packed state of the container may include that the portion of the connecting means that can be detached from the container is stored in, on, at, or at least close to the container or forms an integral part of the container, for example as an integral part of a housing or outer enclosure of the container, and/or is otherwise not detached from the container. In some examples, the packed state of the container may refer to a state of the container before the handle has been provided by detaching the portion of the connecting means.

The unpacked state of the container may include that the connecting means is moved away from an initial position, which may correspond to a stored position in, on, at, or at least close to the container as mentioned above. In the unpacked state, the connecting means may still form an integral part of the container, still be detachably attached to the container, or fixed to the container. The unpacked state may also include that the portion of the connecting means is detached from the container. In some examples, the unpacked state of the container may refer to a state of the container during and/or after the handle has been provided by the connecting means. Preferably, at least a part of the detached portion of the connecting means provides the handle.

The connecting means may have an elongated shape and be flexible so as to be at least one of bendable, foldable, windable or twistable, in any combination. In some examples, the connecting means may be formable to make at least one loop. In some examples, the connecting means may comprise at least one of a string, a cord, a rope, a chain, a band or a belt. In the unpacked state of the container, the connecting means may support the container when carried by the carrier. The connecting means at least forwards the supporting force from the carrier to the container.

In some examples, the connecting means may be provided integrally with or as an integral part of the container. Accordingly, the connecting means may be formed as a single piece with the container. Alternatively or additionally, the connecting means may be connected to the container in a manner that the container and the connecting part form an entity. For example, the connecting means may not be removable from the container without destroying its integrity. Such a fixation may be considered as permanent.

In some examples, the connecting means may be fixed to the container non-permanently. For example, the connecting means may be fixed to the container in a detachable manner. For example, the connecting means may be fixed or connected to the inside or outside of the container, such as to a housing or enclosure of the container, using fastening means, such as adhesive means. Accordingly, the connecting means may be detached from the container in a manner similar to detaching the detachable portion from the container as described above, which may at least partially break or rip the fastening means.

The connecting means may be fixed to the container in a mechanical, physical, chemical manner or a combination thereof. For example, the connecting means may be fixed to the container by gluing, taping, clipping, pinning, screwing, melting, welding, soldering, or any other proper means of fixation.

The connecting means can be detached, either fully or partially, from the container. In some examples, the portion extending from the container after being detached may be variable and can be expanded by moving it further away from the container. In some examples, a predefined portion of the connecting means may be detachable from the container. In some examples, the portion of the connecting means that is detachable from the container extends, fully or partially, between a position where the connecting means is fixed to the container and an end portion of the connecting means that is detached from the container.

In the unpacked state of the container, the connecting means or the portion thereof that is detached from the container at least partially spans a circumference of the container. Generally, the circumference that is at least partially spanned by the connecting means may refer to any portion of the outer face of the container. The part of the connecting means that spans the part of the circumference of the container may be arranged adjacent to the outer face of the container.

The connecting means may comprise a portion to be arranged such as to be suitable for being supported by a carrier, thereby providing a handle. In some examples, the handle is part of the portion of the connecting means that is detachable or detached from the container. The handle may provide a string-shaped portion, a surface, or the like that is suited for being supported by a carrier. For example, the connecting means comprises one or more loops of strings that are configured, and can be arranged, such as to be held together by a carrier, such as a human hand.

In some examples, the carrier may be a person or a device capable of transporting the container. For example, the carrier may be capable of grabbing the handle to support the handle and thereby carry the container as a whole. When grabbing the handle, the carrier may perform work, in terms of physics, against the gravitational force.

Accordingly, the container may be transformable such as to provide a handle for the portability by a carrier. The container may integrally comprise the structural and/or functional features for providing the handle. In particular, the container may be made portable without providing additional transport means, such as a bag, additional handles or packaging components. Thus, the portability of the container may be improved without requiring additional transport means, thereby reducing at least one of material costs, expenses, time and energy requirements for providing a transport means for the container.

According to one embodiment, the container comprises at least one detachable portion. In the unpacked state of the container, the detachable portion is detached from the container. The connecting means is adapted to engage with the at least one detachable portion of the container to provide the handle.

The detachable portion may refer to a portion of the container that can be separated and/or removed from the rest of the container, thereby detaching the detachable portion from the container. In some examples, detaching the detachable portion may refer to physically spacing at least a part of the detachable portion from the container, for example, by separating and/or removing a part of a housing or outer enclosure of the container forming at least a part of the detachable portion from the container. Here and in the following, the term "detachable portion" refers to one or more, at least one or a plurality of, detachable portions, unless indicated otherwise.

In some examples, the detachable portion may be located on the outside or on the outer surface of the container. For example, at least a part of the detachable portion may form part of a housing or outer enclosure of the container. In some examples, the detachable portion may comprise or form a surface that may define at least a part of the handle. The surface may be planar, curved, edged, stepped, polygonal, or a combination thereof. In some examples, the connecting means may, in the unpacked state of the container, connect the detachable portion with the container.

The detachable portion may be detached from the container by moving, rotating, tearing, pulling, pushing or otherwise forcing it off of the container. Additionally or alternatively, a part of the detachable portion may be detachable from the container, for example by folding, flapping, pivoting, shifting, or by any of the aforementioned actions, while at least another part of the detachable portion is connected or fixed to the container.

In some examples, the detachable portion may refer to a part that has been detached from the container and/or to the corresponding opening or recess formed by detaching the detachable portion.

The connecting means may engage with the detachable portion in a mechanical manner. In some examples, said engaging refers to bringing the connecting means into physical contact with the detachable portion such that at least a section or part of the connecting means, such as at least a part of the detached portion of the connecting means, is guided by and/or arrested in, at or with at least a part of the detached detachable portion of the container. For example, the detachable portion of the container, in the unpacked state of the container, may provide a hollow space or cavity, such as a groove, a recess or a trench in a housing or enclosure of the container, in which a part of the connecting means, such as at least a part of the detached portion of the connecting means, may be guided or arrested.

In some examples, the detached portion of the container together with the (at least a part of the detached potion of) connecting means provides a handle when engaging with one another. For example, the (detached) connecting means may have one or more loops of strings that can be hooked into a recess of the detached portion of the container. In some examples, the connecting means may be fixed or otherwise connected to the detached portion of the container. When engaged, the detached portion of the container may provide a surface to be supported by a carrier, while the connecting means contributes to the carrying force of the carrier to be forwarded to the container, thereby supporting it.

In some examples, the container comprises more than one (multiple) detachable portions. In these examples, the connecting means may engage with at least one, a part, or all of the multiple detachable portions to provide the handle.

According to an embodiment, in the unpacked state of the container, the at least one detachable portion detached from the container provides a part of the handle having a surface suitable for being supported by a carrier. Preferably, the handle may provide a surface that is suited for being supported by a human hand.

In this disclosure, the term detached portion, for instance, refers to the detachable portion of the container being detached from the container. The detachable portion of the container may be detached from the container in the unpacked state of the container. In some examples, the shape of the surface of the handle corresponds to a surface of the detached portion. For example, the detached portion may be separated from a portion of the container forming an edge or an edgy portion of the container, and the surface of the handle may comprise a corresponding edge. In another example, the detached portion may be separated from a portion of the container forming at least partially a flat part or a planar portion of the container, and the surface of the handle may comprise a corresponding flat part. In yet another example, the detached portion may be separated from a portion of the container forming at least partially a curved part or a curved portion of the container, and the surface of the handle may comprise a corresponding curved part. The surface of the handle may comprise a combination of the above examples or any further shape with respect to the shape of the container or a shape of a respective housing or enclosure of the container. Furthermore, the surface of the handle may comprise a combination of the aforementioned examples.

With the handle being provided with the detached portion, the shape of the handle may be modified and/or designed by correspondingly shaping the container at the detached portion. The shape of the handle may be further modified and/or designed by providing mechanical means in the detachable portion, such as a perforation or a guiding means that may be used to fold or modify the detached portion. Additionally or alternatively, the shape of the handle may be at least initially determined by the position of the detached portion at the container. Thus, the variability of designing the handle may be increased.

According to an embodiment, the container has at least one edge. At least a portion of the container is detachable at the at least one edge of the container. The at least a portion of the container may form the at least one detachable portion of the container, according to one or more embodiments, as described above.

The at least one detached portion, being detached from an edge of the container, may comprise a fold that corresponds to the portion of the edge the portion is separated from. The fold may be used for guiding and/or arresting the connecting means. A means may be provided for arresting the connecting means, after engaging, with the detached portion to provide the handle. For example, the means may include an adhesive portion or a mechanical structure, and the like, in any combination, in order to engage the connecting means with the detached portion.

According to an embodiment, the connecting means is fixed to the container in a location at or in the container.

In some examples, the connecting means may be fixed, in at least one of the packed or unpacked states of the container, onto a sidewall of the container. In some examples, the connecting means may be, in at least one of the packed or unpacked states of the container, at least partially embedded in a sidewall of the container. The sidewall may form part of at least a part of a housing or enclosure of the container. The connecting means may be fixed to the container on the inside or on the outside thereof. The connecting means may be fixed to the container by any proper means of fixation as discussed above.

With the connecting means being fixed to the container, the material required for providing a transport means for the container may be reduced. Furthermore, the process of providing the container with a transport means may be facilitated.

According to an embodiment, in the unpacked state of the container, the connecting means is adapted to engage with the detachable portion in a location spaced apart from the container.

The location may refer to where the connecting means engages with the detached portion. The location may be a location that is not in physical contact with the outside of the container. The connecting means may still be fixed to the container when engaging with the detached portion. In other examples, the connecting means may be detached from the container when engaging with the detached portion.

In particular, when being supported by the carrier, the location may be above the container with respect to the gravitational force. Accordingly, the handle may be provided above the container, allowing for holding the container from above. Furthermore, with the handle being spaced apart from the container, handling of the container in terms of portability may be enhanced. For example, the handle may be easier to grab without interfering with the remaining container since it is spaced apart from the container. In the unpacked state, the detachable portion forming the handle may be spaced apart by a distance.

According to an embodiment, in the unpacked state of the container, the connecting means is adapted to wrap around the container.

For example, wrapping may include moving the connecting means along an outer circumference of the container. The wrapping may include at least partially winding the connecting means around the outer circumference of the container. The connecting means wrapping around the container may at least partially be in physical contact with the container. At least a portion or section of the connecting means wrapping around the container may be spaced from the container, for example, to engage with the detached portion and spaced apart detachable portion forming at least a part of the handle. Preferably, at least a portion or section of the connecting means wrapping around the container may be guided by a structure or recess, which may be provided in a housing or enclosure of the container or which may be formed in the container by detaching the detachable portion.

In some examples, the connecting means may comprise a portion that is at least as long as one outer circumference of the container. In some examples, the connecting means may comprise multiple parts that are altogether at least as long as one outer circumference.

For example, the outer circumference may fully circumscribe the container. For example, the outer circumference may be measured along a height direction of the container, a length direction of the container, an oval or circular diameter of the container, or a combination thereof. The outer circumference may be measured such as to provide a stable holding of the container when carried by a carrier at the handle. In this regard, the outer circumference may be determined relative to the center of mass of the container and/or a symmetrical axis of the container, if applicable.

In some examples, the connecting means comprises multiple strings or string-like portions that wrap around the container, wherein each of the multiple strings or string-like portions are at least as long as one outer circumference of the container.

The connecting means wrapped around the container may exert a pressure towards the container when carried by a carrier. In particular, the connecting means wrapped around the container may hold the container together. In particular, the connecting means wrapped around the container may press an opening, such as a covering lid, towards a body of the container so as to keep the container closed. The container may be secured by wrapping the connecting means around the container.

In a conventional system where the handle forwards the force from a carrier to the interior of the container, the connection of the handle to the container usually needs to be reinforced. According to the present embodiment, the connecting means wrapped around the container may cause the force of the carrier carrying the container to be exerted on the outer surface of the container from the outside. Thus, the connection between the handle and the container may be ensured by mechanical means.

According to an embodiment, in the unpacked state of the container, the connecting means comprises at least one loop. The at least one loop can engage with the handle.

A loop may refer to a curving or doubling so as to form a closed or partly open curve within itself through which another part of the connecting means and/or the detachable portion of the container can be passed. The connecting means may comprise one loop or multiple loops. At least one of the loops may at least partially engage with the detachable portion to form at least a part of the handle. Additionally or as an alternative another at least one of the loops may be wrapped around the container.

Having the at least one loop, engaging the connecting means with the detached portion may be facilitated. Furthermore, the engagement of the connecting means with the detached portion and the wrapped container may be secured.

According to an embodiment, at least one of the container, the at least one detachable portion of the container, or the connecting means is made of a non-synthetic material.

A synthetic material may comprise or refer to a material consisting of any of synthetic or semi-synthetic compounds that can be molded into solid objects. For example, the synthetic material may include any of synthetic polymers that are human-made polymers, such as thermoplastics, thermosets, elastomers and synthetic fibers.

Accordingly, the non-synthetic material may refer to a material that does not containing a synthetic material, including the case of containing a negligible amount of synthetic material. Preferably, non-synthetic materials may include one or more of natural material or natural fiber, such as paper, cardboard, hemp, feathers, linen, cotton, coir, jute, straw, sisal, or the like, in any combination, Synthetic materials often are not or hardly biodegradable and endure a long period of time before decomposition. Thus, the exclusion of synthetic materials in any of the container, detachable portion and connecting means reduces the amount of the synthetic materials to be disposed as waste in an environment-friendly manner.

According to an embodiment, the at least one detachable portion of the container and the container are made of the same material. For example, at least a part of the container, such as housing or outer enclosure, and the detachable portion may be made of cardboard. However, it is to be understood that the present disclosure is not limited to cardboard only and any material of the housing or outer enclosure of the container may be used to define the detachable portion.

The detachable portion and at least part of the container may be made of one single piece. In some examples, the detachable portion is an integral part of the container as discussed above. For example, the detachable portion and the container are made of cardboard. In further examples, the detachable portion and the container comprise any biodegradable material or a material that naturally decomposes within several years.

Accordingly, providing the detachable portion with the container is facilitated. Further, using an environment friendly material for both the detachable portion and the container is facilitated.

According to an embodiment, at least one portion of the container is marked as detachable from the container for optical perception, haptic perception, or a combination thereof. The marked portion of the container may correspond to the detachable portion of the container.

Marking the detachable portion may include providing features at the container that indicate the detachable portion. In some examples, the marking process may allow for the detachable portion to be perceived visually or haptically for human eyes or human touch, respectively. For example, the detachable portion may be outlined, shaded, differently colored, marked with a pattern, or a combination thereof for the optical or visual perception. For example, at least a part of the detachable portion may be provided with bulges, a curvature, a different roughness, grooves, perforations or the like or a combination thereof for the haptic or tactile perception. The marking may further simplify removal or detaching of the detachable portion from the container.

Thus, the detachable portion may be highlighted, allowing for a quick detection and removal by a user.

According to an embodiment, the container is a box. At least one portion of the container, such as the at least one detachable portion of the container according to embodiments of the present disclosure, may be provided detachable from an edge portion of the container. The connecting means may comprise a string connected to the at least one detachable portion and to the container. It is to be understood that even though a cardboard box as container and a string as connecting means define a preferred embodiment, the present disclosure is not limited to such a configuration. Rather any other container of a different shape, such as a cylindrical container, a receptacle or the like, and any other connecting means, such as a chain, a belt or the like, may be used in other embodiments of the present disclosure.

A box may be based on a block having a rectangular cross section in the height and length directions. The box may comprise at least one lid to cover the rest of the container body. The at least one lid may be openable by completely separating it from the container. Alternatively or additionally, the at least one lid may be openable by sliding or pivoting without removing it completely from the container.

The detachable portion, being detached from the container, may comprise a part of the edge which the detached portion is removed from. Accordingly, the detached portion may comprise an edge that corresponds to the edge of the container in terms of angle and measures.

The string may comprise threads of a flexible material twisted together to form a thin length. For example, the string is made of a material comprising cloth, leather, cotton, hemp, or the like.

According to an embodiment, in the unpacked state of the container, the connecting means is adapted to be arranged on the outside of the container.

In the packed state of the container, the connecting means may be arranged in the inside or on the outside of the container. With the connecting means being arranged outside in the unpacked state of the container, the force of the carrier holding the handle may be forwarded to the container from the outside, as discussed above.

According to a further aspect of the disclosure, a system is provided comprising a container or any of the embodiments as described above.

The system may contain at least the connecting means, the detachable portion and the container as described above as one entity or as separate parts to be jointed to one another.

According to a further aspect of the disclosure, a method for providing a container with a handle is provided. According to the method, a container is provided with a connecting means as an integral part of, or being detachably mounted to, the container. At least a portion of the connecting means is detached, which may include being separated, from the container. The detached or separated at least a portion of the connecting means is arranged such as to span at least a part of a circumference of the container. With the at least a portion of the connecting means being detached, the connecting means provides a handle to be supported by a carrier.

According to an embodiment, at least one portion of the container is detached, which may include being separated, from the container. The detached, or separated, at least one portion of the container provides the handle with a surface. The surface may be suitable for being supported by a carrier. The (detached at least a portion of the) connecting means may engage with the detached, or separated, at least one portion of the container.

The method may correspond to providing a handle for the container or any examples thereof described above. Examples and explanations of the method features may correspond to the container as described above.

According to the method, a container may be transformed so as to facilitate the transport by a carrier. No additional transport means is required. Thus, the material, cost, energy and time requirements for providing a transport means for a container may be reduced.

According to an embodiment, the detached at least a portion of the connecting means is wrapped around the container. For example, the detached at least a portion of the connecting means is wrapped around the container before engaging with the detached or separated at least one portion of the container.

Details on the process of wrapping the connecting means around the container may correspond to the description of one or more embodiments of a container, detailed above.

According to an embodiment, the container may be preprocessed such that the at least one portion of the container is detachable from the container by pulling, pushing, or a combination thereof.

In particular, the process of pulling and/or pushing may include manually interacting with the respective area of the container. With respect to the container, pulling may refer to applying physical strength outwards. Pushing may refer to applying physical strength inwards with respect to the container. For example, the at least one portion may be first pushed inwards and thereafter pulled to be separated from the container. In yet another example, the at least one portion may be pulled only.

Accordingly, detaching the detachable portion may be achievable by using physical strength only, thereby facilitating the process of detaching the detaching portion.

BRIEF DESCRIPTION OF THE SEVERAL VIEWS OF THE DRAWINGS

The specific features, aspects and advantages of the present disclosure will be better understood with regard to the following description and accompanying drawings where.

DETAILED DESCRIPTION

In the following description, reference is made to drawings which show by way of illustration various embodiments. Also, various embodiments will be described below by referring to several examples. It is to be understood that the embodiments may include changes in design and structure without departing from the scope of the claimed subject matter.

Figure 1:
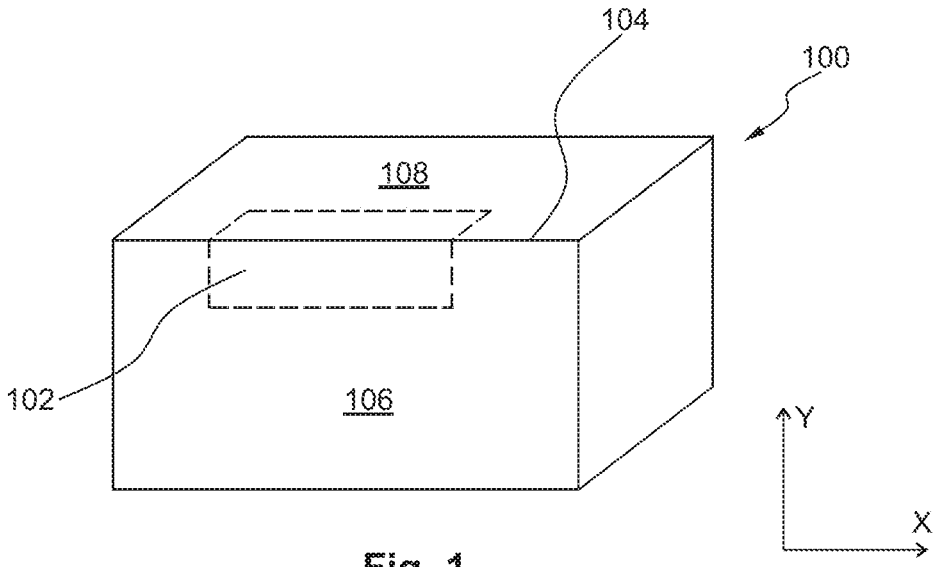
FIG. 1 is a view of an example of a container in a packed state according to an embodiment.

FIG. 1 shows a perspective view of a container 100 in a packed state according to an embodiment. The container 100 may have a polyhedron shape with a rectangular cross section in both length and height directions, which are schematically indicated with arrows X and Y in FIG. 1. The container may have the shape of a box.

The container 100 may be capable of housing a physical item including consumer goods such as cloths, footwear, consumer electronics or the like. For this purpose, the container 100 may comprise a portion (not shown) that is openable by moving in a specific way, such as sliding or pivoting, and/or being separated from the rest of the container 100.

A detachable portion 102 is indicated by dashed lines. The detachable portion may be located at an edge 104 of the container 100. The edge 104 may be formed by the different angles between two adjacent sidewalls 106, 108 of the container 100.

The detachable portion 102 may be marked so as to be optically perceptible by a human user. For this purpose, the detachable portion 102 may be marked in any visual manner as above described. For example, the detachable portion 102 may be outlined with a dashed line as shown in FIG. 1.

The detachable portion 102 may be marked (not shown in FIG. 1) so as to be haptically perceptible by a human user. For this purpose, the detachable portion 102 may be marked in any tactile manner as above described. For example, the boundary of the detachable portion 102 (corresponding to the dashed line) may be perforated so as to be both haptically perceptible and easily to break up.

The detachable portion 102 may be an integral part of the container 100. Alternatively, the detachable portion 102 may be attached to the container 100 by gluing, inserting into a slot, or the like. The detachable portion 102 and the container 100 may be made of a biodegradable material such as cardboard or wood.

Figure 2:
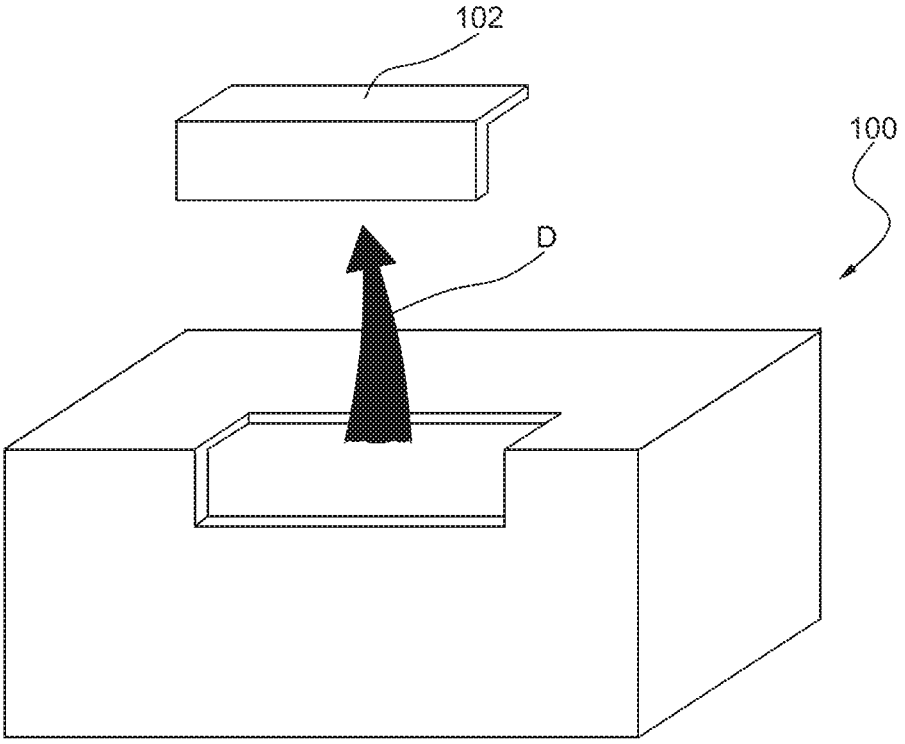
FIG. 2 is a perspective view of the container of FIG. 1 in an unpacked state according to an embodiment.

FIG. 2 shows a perspective view of the container 100 of FIG. 1 in an unpacked state. The arrow D indicates the detaching movement of the detachable portion 102 being detached from the body of the container 100. A detachable portion of a container being detached from said container may be referred to as detached portion.

The detachable portion 102 may be detached from the container 100 by pulling it from the container 100, by pushing it inwards, or by otherwise tearing it from the container 100. Though not shown in FIG. 2, the detachable portion 102 may be, either in the packed or in the unpacked state of the container, connected with a first end of a connecting means that is fixed to the container 100 at its second end.

Figure 3:
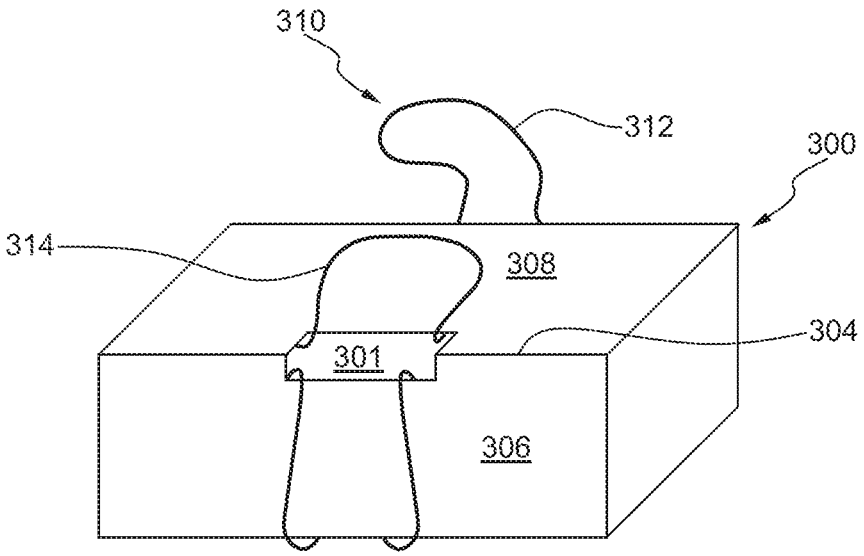
FIG. 3 is an example view of another example of a container in an unpacked state according to an embodiment.

FIG. 3 shows a perspective view of another example of a container 300 in an unpacked state. The container 300 may have a shape that is similar to the container 100 as shown in FIGS. 1 and 2. The container 300 may be similar or identical to the container 100 in terms of the functional and structural features above described.

In FIG. 3, a portion of the container has been detached from the container 300. The detached portion may be pushed into the container 300, pulled out off of the container 300, or otherwise ripped or torn apart from the container 300. In the example of the container 300 in FIG. 3, the detached portion is taken from an edge 304 between two adjacent sidewalls 306, 308 of the container 300.

With the detached portion 302 being detached from the container 300, an opening 301 or a recess (not shown) is formed in the position where the detached portion 302 has been removed from. In the example of the container 300 being a cardboard box, detaching the detached portion 302 from the container 300 may form a through-hole 301 at the edge 304 corresponding to the size of the detached portion 302.

A connecting means 310 may be fixed to the container 300. The connecting means 310 may be fixed to the container 300 on the inside. Additionally or alternatively, at least part of the sidewalls 306, 308 of the container 300 may comprise multiple layers, and the connecting means 310 may be fixed to the container 300 between the layers. The connecting means 310 may be glued to the container 300. The connecting means 310 may be fixed to the container 300 in a permanent manner such that, for instance, the connecting means 310 may not be removable from the container 300 without destroying its integrity. Alternatively, the connecting means 310 may be attached to the container 300 in a detachable manner such that, in the unpacked state of the container 300, the connecting means 310 is detached from a position in or at the container 300 where the connecting means 310 was fixed in the packed state of the container 300, and wrapped around the container 300 to engage with the detached portion 302.

The connecting means 310 may comprise at least one string fixed to the container. The connecting means 310 may comprise a first loop 312 and a second loop 314. The first and second loops 312, 314 may have different lengths. The connecting means 310 may be provided as a single piece fixed to the container 300 in a manner that the first loop 312 has a greater length than the second loop 314. Alternatively or additionally, the first and second loops 312, 314 may be separate from one another.

In the example shown in FIG. 3, the first loop 312 may be measured such as to extend downwards (in the orientation of FIG. 3) from the opening 301 to encircle the container 300 along an outer circumference. The second loop 314 may be measured such as to extend from the opening 301 upwards (in the orientation of FIG. 3). The loops 312, 314 may be measured such as to converge in a location above the container 300 that is spaced apart from the top sidewall 308 of the container 300. The location in which the first and second loops 312, 314 converge may be central relative to the top sidewall 308 in a top view (in the orientation of FIG. 3). Alternatively, the loops 312, 314 may be measured such as to converge in a location close to and/or spaced apart from any other sidewall of the container 300. For example, the loops 312, 314 may have a respective length such that they converge in a location below the sidewall opposite to the top sidewall 308. In this example, when the handle is provided, the container 300 may be carried with the top sidewall 308 down.

In the example of container 300 shown in FIG. 3, the first and second loops 312, 314 may comprise portions of strings that can be held together by a carrier, e.g., by a human hand, thereby providing a handle. Such a handle may be suitable for being supported by the carrier.

Figure 4:
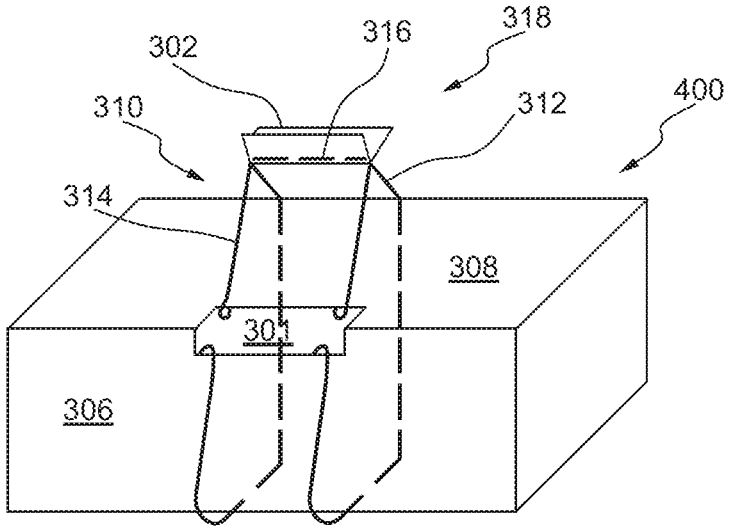
FIG. 4 is an example view of yet another example of a container in an unpacked state according to an embodiment.

FIG. 4 shows a perspective view of another example of a container 400. The container 400 may comprise at least part of the structural and functional features of the container 300 as shown in FIG. 3 and described above. In particular, the container 400 may comprise all of the features of the container 300 described above. The container 400 may comprise at least the features that are required for the features that are described in the following.

In addition, the loops 312, 314 may be measured such as to extend along a groove 316 that is formed on the inner side of the fold of the detached portion 302. The connecting means 310 may engage with the detached portion 302 by hooking the first and second loops 312, 314 into the groove 316. With the connecting means 310 engaging with the detached portion 302, the surface of the detached portion 302 that is facing the container 400 may be suitable for being held by a carrier. Accordingly, the container 400 is provided with a handle 318 to be carried by a carrier.

In examples not shown in FIGS. 3 and 4, the connecting means 310 may be provided as a single piece which as a whole forms a closed loop. For example, the connecting means 310 may be detachably attached to the inside of the container 300 and may be forcibly detached from the container 300. With the opening 301 providing a recess in the outer surface of the container 300, the connecting means 310 may be arrested within the opening 301 when being carried by a carrier. In addition, the container 300 may have a groove, recesses, or the like to receive the connecting means 310, thereby arresting it when being carried.

Figure 5:
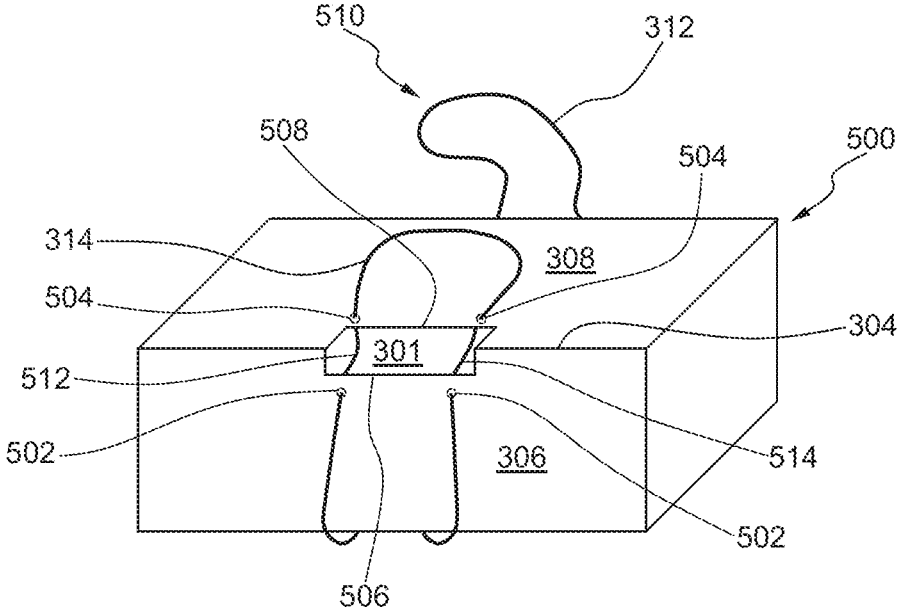
FIG. 5 shows a perspective view of a container in an unpacked state according to one embodiment.

FIG. 5 shows a perspective view of another example of a container 500 in an unpacked state. The container 500 may have a shape that is similar to either of the containers 100, 300 and 400 as shown in FIGS. 1-4 and described above. The container 500 may be similar or identical to either of the containers 100, 300 and 400 in terms of the functional and structural features above described.

The container 500 comprises a plurality of through-holes 502, 504 formed in the sidewalls 306, 308. In the example shown in FIG. 5, two through-holes 502 are formed in the front sidewall 306, and two other through-holes are formed in the top sidewall 308. In the example shown in FIG. 5, the through-holes 502, 504 are formed close to horizontal edges 506, 508. In other examples that are not shown herein, the through-holes may be formed anywhere else in the respective sidewalls 306, 308. Further, the numbers of the through-holes that are formed in either of the sidewalls 306, 308 may vary.

Figure 6:
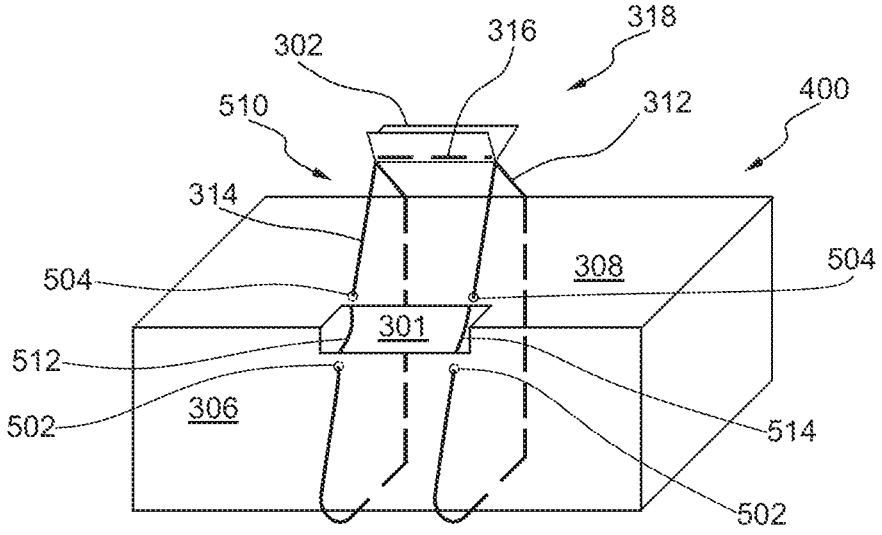
FIG. 6 is yet another perspective view of a container according to one embodiment.

In an example, the connecting means 510 as shown in FIGS. 5 and 6 is provided as a single piece. The connecting means as a whole may form a closed loop. The connecting means 510 is guided through the through-holes 502, 504 such that portions of the connecting means 510 pass outside of the container 500 between the through-holes 502 and between the through-holes 504, respectively. These portions located outside of the container 500 provide the first and second loops 312, 314.

As shown in FIGS. 5 and 6, portions 512, 514 of the connecting means 510 extend inside the container 500 between the openings 502, 504. The portions 512, 514 may comprise portions of the connecting means that are stored inside the container 500. In particular, the connecting means 510 may be slidable through the through-holes 502, 504 such as to enable the lengths of the loops 312, 314 to be adjusted, for example, by pulling. In case that the connecting means 510 is provided as a single piece forming a closed loop, either of the loops 312, 314 may be retractable by pulling at the respectively other loop 312, 314.

FIG. 6 shows a perspective view of another example of a container 600, which in particular may comprise most or all of the structural and functional features of the container 500 as shown in FIG. 5 as described above. In particular, the container 600 has through-holes 502, 504 through which the connecting means 510 is guided in the above described manner. The container 600 further comprises a detached portion 302 that is used as a handle, as described above with reference to FIG. 4.

Figure 7:
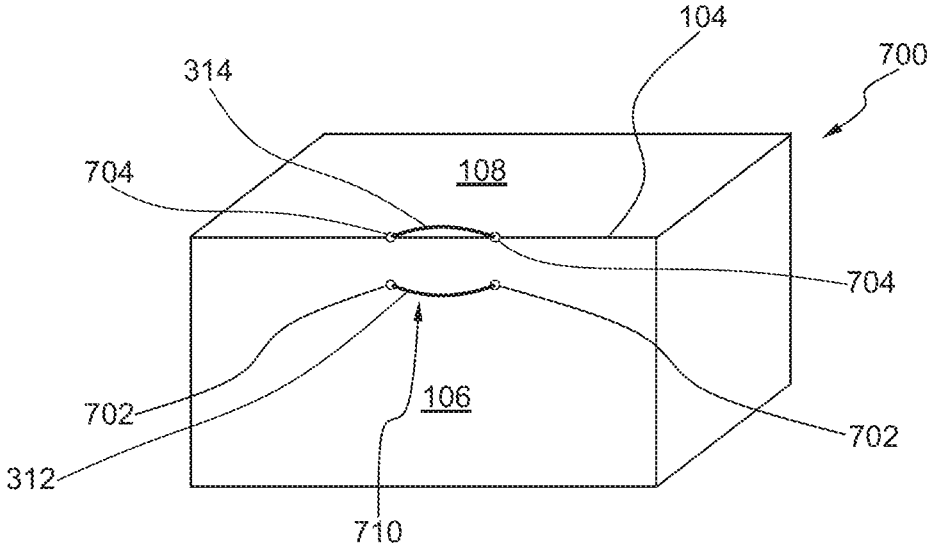
FIG. 7 shows a perspective view of a container in its packed state according to one embodiment.

FIG. 7 shows a perspective view of another example of a container 700 in its packed state. The container 700 may be similar or identical to either of the containers 100, 300, 400, 500 and 600 in terms of the functional and structural features above described.

The container 700 has the shape of a box with a front sidewall 106 and a top sidewall 108 forming an edge 104 therebetween. The container 700 comprises two through-holes 702 formed in the front sidewall 106 and two through-holes 704 formed in the top sidewall 108. A connecting means 710 is guided through the through-holes 702, 704 such as to form a first loop 312 and a second loop 314 that are located outside of the container 700. The remainder of the connecting means 710 is stored in the interior of the container 700.

The connecting means 700 may be slidable through the through-holes 702, 704, thereby allowing the first and second loops 312, 314 to be extended by pulling out. In some examples, the connecting means 710 may be provided as multiple pieces attached to the container in a similar manner as described above and shown in FIGS. 3 and 4. In some other examples, the connecting means 700 may be provided as a single piece forming as a whole a closed loop passing through the through-holes 702, 704. In the latter case, either of the loops 312, 314 may be retractable by pulling at the respectively other loop 312, 314.

Figure 8:
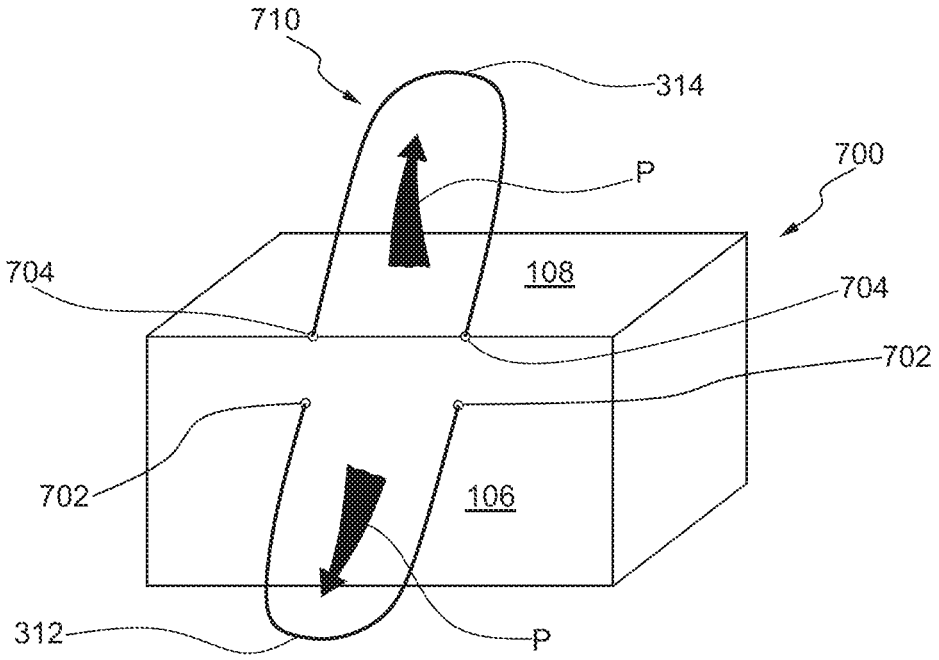
FIGS. 8 and 9 illustrate containers according to embodiments in their unpacked states.
Figure 9:
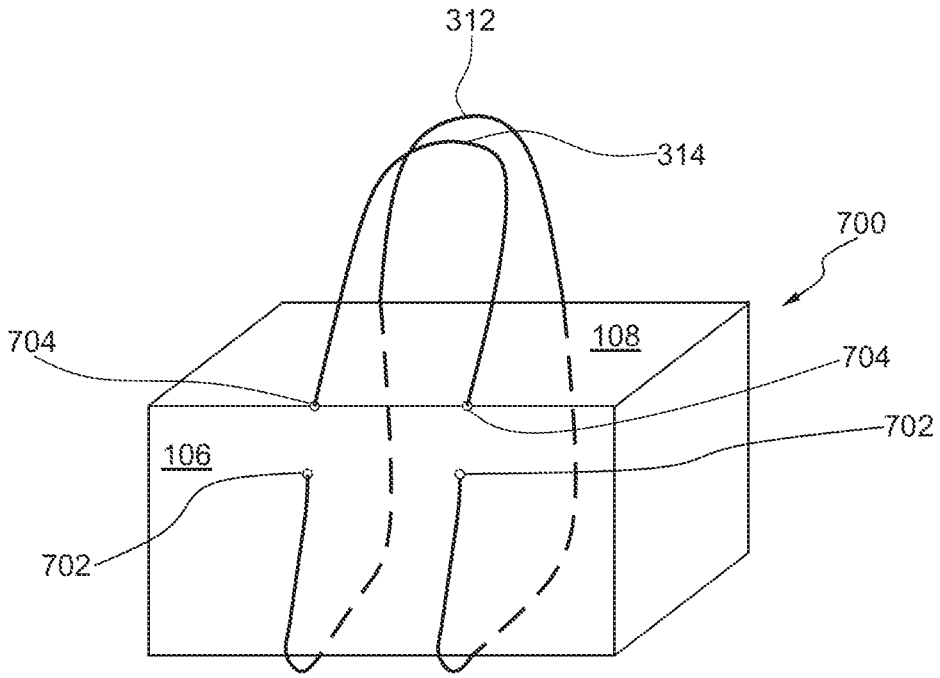

The container 700 may be transformable into at least two different unpacked states. In a first unpacked state as shown in FIGS. 8 and 9, a user may extend the first and second loops 312, 314 by pulling them out, as indicated by arrows P in FIG. 8. Then, the first loop 312 may be wrapped around a circumference of the container 700 such that an end portion of the first loop 312 is located above the top sidewall 108 of the container 700. Correspondingly, the second loop 314 may be extended such that an end portion thereof is located above the top sidewall 108 in a manner to converge with the end portion of the first loop 312. The end portions of the loops 312, 314 may provide a handle to be carried by a user.

Figure 10:
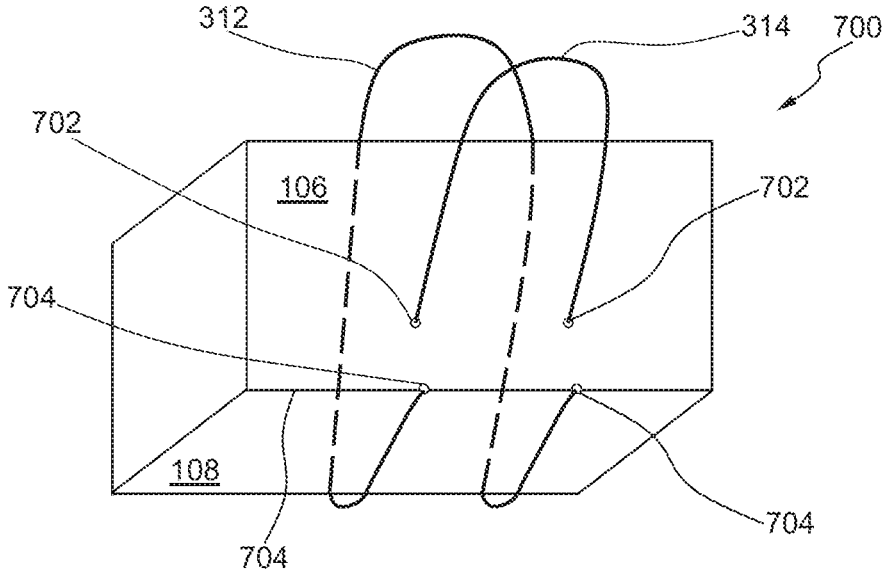
FIG. 10 shows yet another view on a container according to one embodiment.

In further examples, the loops 312, 314 may converge at any other side of the container 700. For example, the loops 312, 314 may be measured such as to converge over a sidewall of the container 700 opposite to the top sidewall 108, as shown in FIG. 10.

Figure 11:
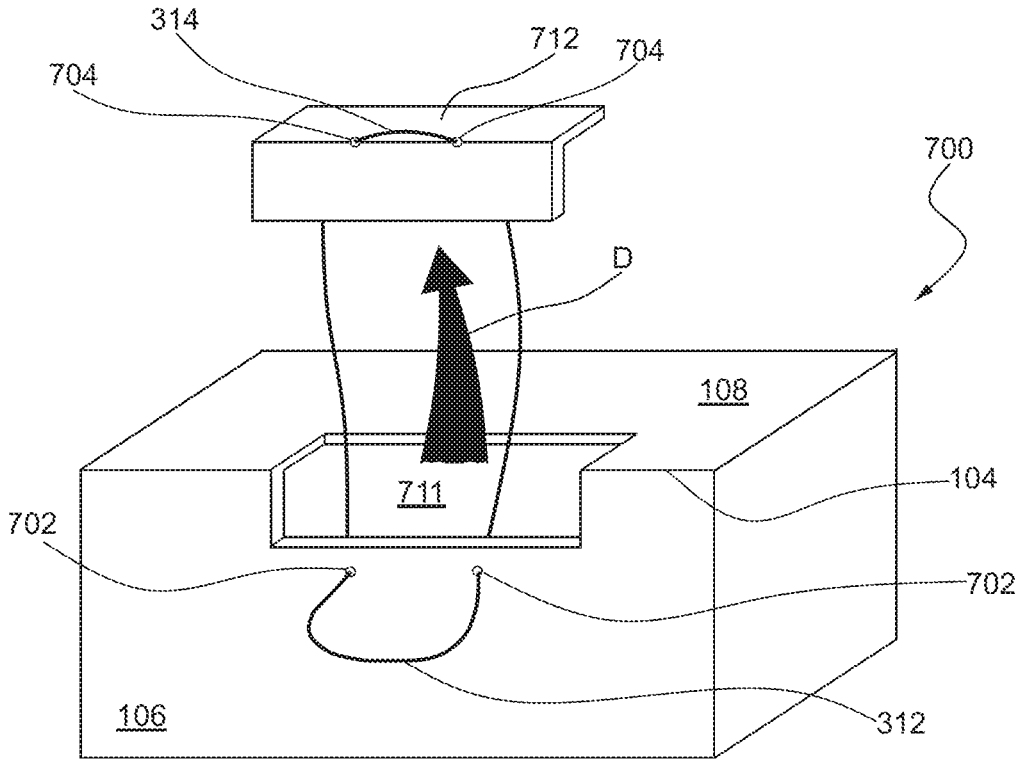
FIG. 11 illustrates a schematic view on a container according to an embodiment in an unpacked state.

In a second unpacked state as shown in FIG. 11, a portion of the container may be detachable (as indicated by arrow D) from the container 700 so as to form a detached portion 712 and an opening 711 in the container 700 when being detached. As depicted in FIG. 10 and similar to the container 100 in FIG. 2, the detachable portion 712 may be formed at the edge 104 between the sidewalls 106, 108. In a manner similar to providing the handle 316 described above with reference to FIG. 4, the first loop 312 may be wrapped around a circumference of the container 700 and be engaged with the detached portion 712 to provide a handle. In a specific example, the detached portion 712 may be flapped to build a fold inside which the second loop 314 is received.

Figure 12:
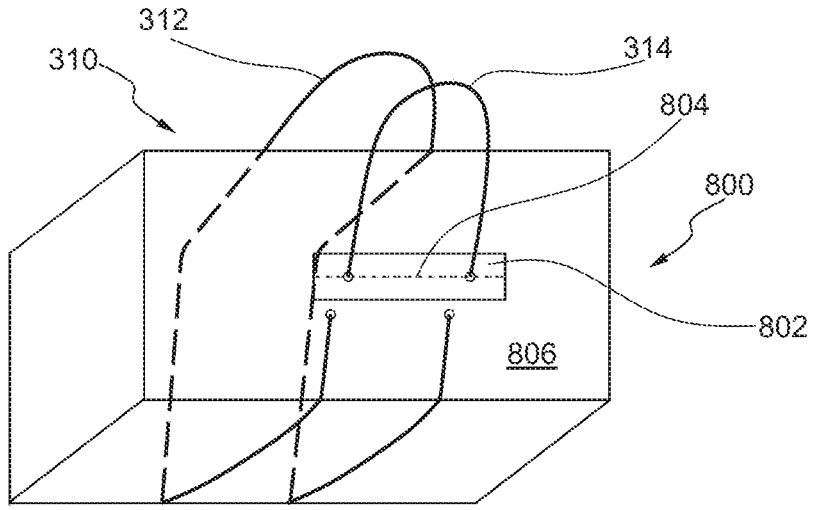
FIG. 12 shows a perspective view of a container according to one embodiment in its packed state.

FIG. 12 shows a perspective view of another example of a container 800 in its packed state. The container 800 comprises a detachable portion 802 that is located within a single sidewall 806. Otherwise, the container 800 may be comprise functional and/or structural features that are similar or identical to those of either of the containers 100, 300, 400, 500, 600 and 700.

The detachable portion 802 may be foldable along a central line 804 as indicated in FIG. 12. The detachable portion 802 may be detached from the container 800 in any manner described above. In the unpacked state of the container 800, a first loop 312 of the connecting means 310 may be engaged with the detached portion 802 to provide a handle to be carried by a user.

Figure 13:
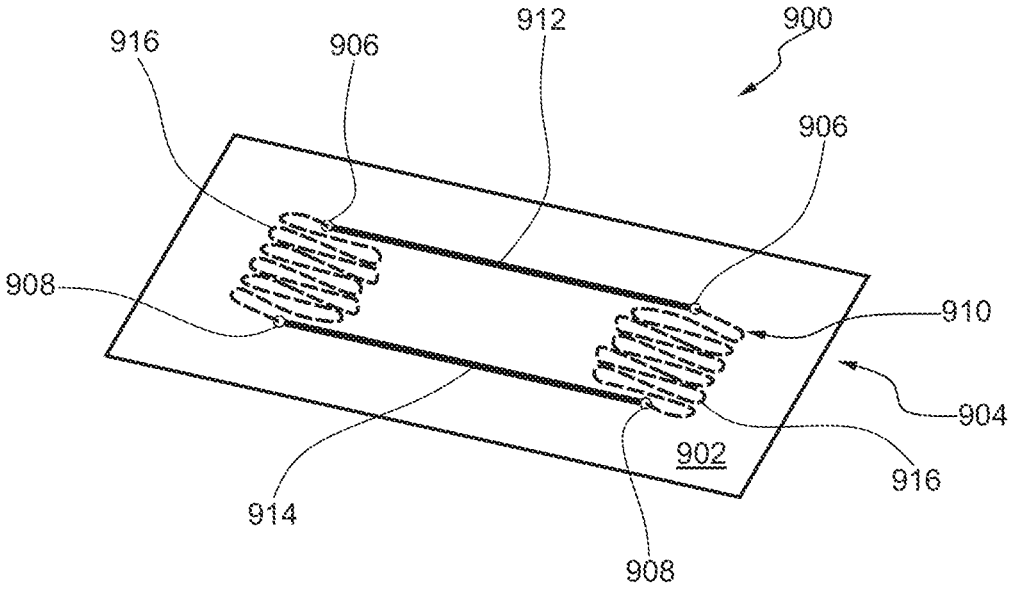
FIG. 13 illustrates a schematic view of a connecting means according to one embodiment.

FIG. 13 shows a schematic view of an example of a connecting means 900 that is attachable to a container. The connecting means 900 is generally planar or patch-shaped and has a first surface 902 and a second surface 904 that are opposite to each other. Through-holes 906, 908 are formed between the two surfaces 902, 904, through which a string 910 is guided such that a first loop 912 and a second loop 914 are located on the side of the first surface 902, and the remainder 916 of the string 910 is located on the side of the second surface 904. The remainder 916 of the string 910 is stored such as to facilitate either of the loops 912, 914 to be extended by pulling.

In some examples, the string 910 is provided as a single piece forming a closed loop having loop forming portions 912, 914 passing between the through-holes 906 and through-holes 908, respectively, on the side of the first surface 902. The string 910 may comprise stored portions 916 passing between one of the through-holes 906 and the corresponding one of the through-holes 908 on the side of the second surface 904. Either of the loops 912, 914 may be extendable by pulling out. If the string 910 is provided as a single piece as a whole forming a closed loop, either of the loops 912, 914 may be retractable by pulling at the respective other loop 912, 914.

Figure 14:
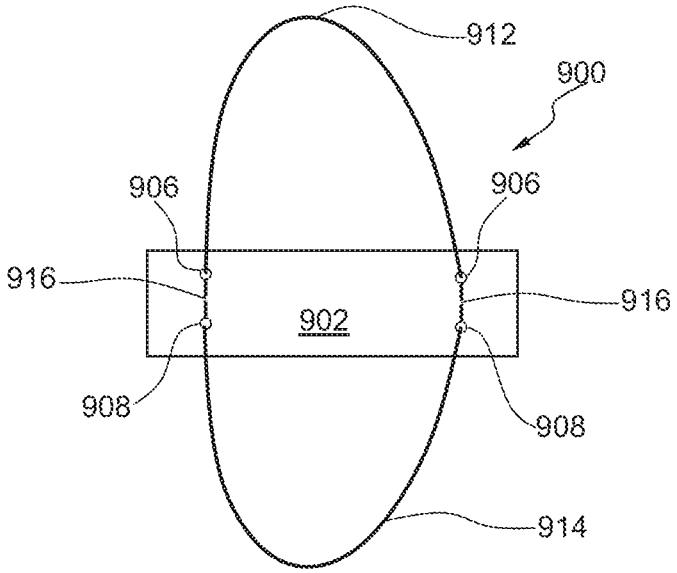
FIG. 14 schematically shows loops of the connecting means applicable in embodiments of the present disclosure.

FIG. 14 schematically shows the loops 912, 914 of the connecting means 900 being extended. Accordingly, the remainder 916 of the string 910 that is stored on the side of the second surface 904 is reduced so as to extend between the adjacent through-holes 906, 908.

Figure 15:
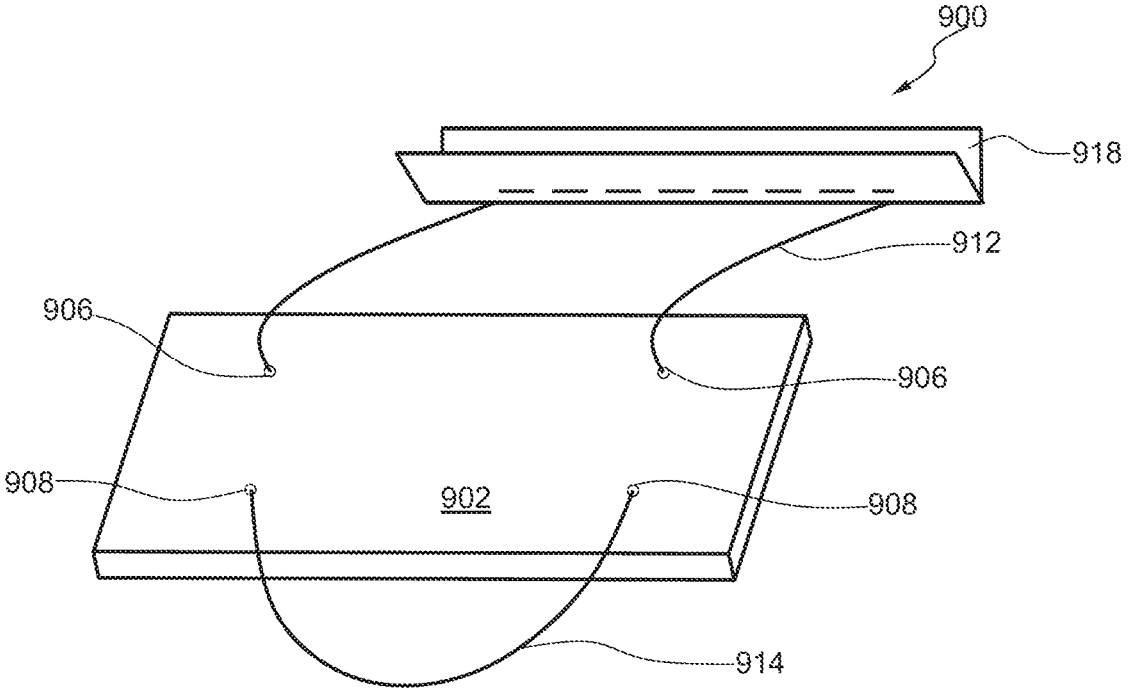
FIG. 15 shows yet another example of connecting means applicable in embodiments of the present disclosure.

FIG. 15 shows an example of the connecting means 900, having a folded portion 918 attached to the first loop 912. In this example, the second loop 914 may be engaged with the folded portion 918 to provide a handle to be carried by a user.

Figure 18:
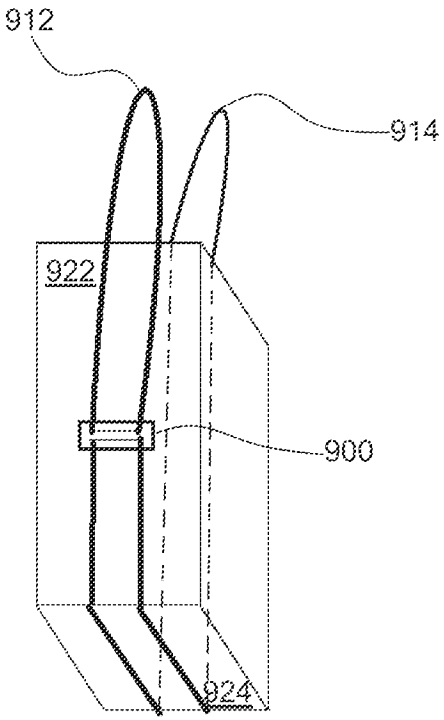
FIGS. 16 to 18 illustrate connecting means attached to a container according to embodiments of the present disclosure.
Figure 17:
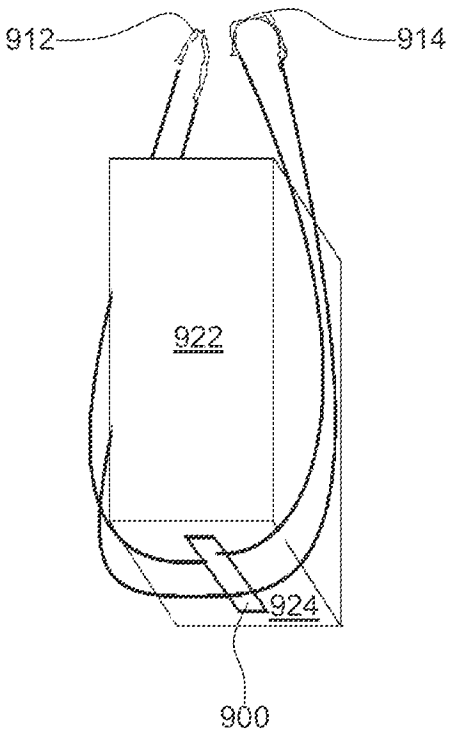
Figure 16:
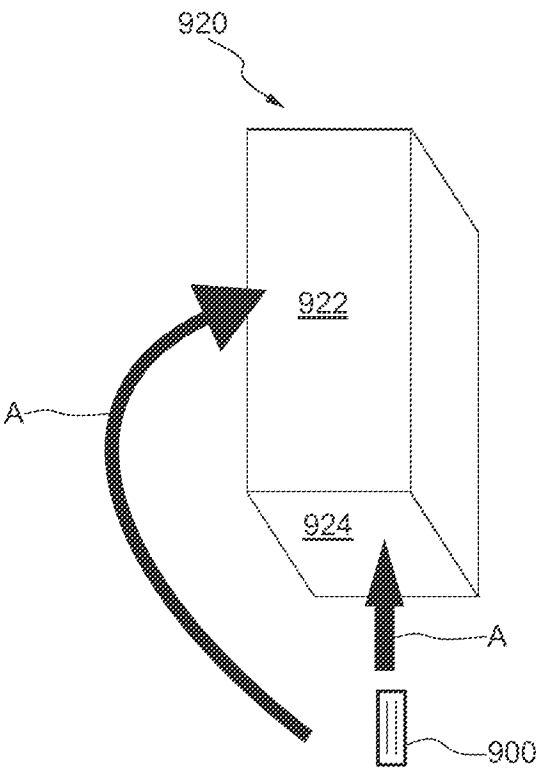

FIGS. 16 to 18 schematically show examples of the connecting means 900 being attached to a container 920. As shown in FIG. 16, the connecting means 900 may be provided separately from the container 920. The connecting means 900 may be attachable to the container 900, for example, by gluing, by means of an adhesive or any other suitable means.

The connecting means 900 may be attached (as indicated by an arrow A in FIG. 16) to any portion of the container 922 including a surface, an edge, or a combination thereof. In the example of FIG. 17, the connecting means 900 is attached to a bottom surface 924 of the container 900. In the example of FIG. 18, the connecting means 900 is attached to a front surface 922 of the container 900.

When being attached, the loops 912, 914 may be extended, for example by pulling out. Alternatively or additionally, the connecting means 900 may be detachable from the container 920 after the loops 912, 914 are arranged so as to provide a handle. Either of the loops 912, 914 may be extended so as to converge in a location spaced apart from the container 920 to provide a handle to be carried by a user as described above. As shown in FIGS. 17 and 18, either or both of the loops 912, 914 may be at least partially wrapped around a circumference of the container 920 in this process.

While some embodiments have been described in detail it is to be understood that the aspect of the disclosure can take many forms. In particular, the claimed subject matter may be practiced or implemented differently from the examples described and the described features and characteristics may be practiced or implemented in any combination. The embodiments shown herein are intended to illustrate rather than to limit the invention as defined by the claims.

The invention claimed is:

1. A container, comprising:

a connecting means including a patch-shaped structure attached to the container, wherein the patch-shaped structure has a first surface facing outward from the container and a second surface opposite to the first surface facing toward the container, and wherein through-holes defined in the patch-shaped structure extend from the first surface to the second surface;

the connecting means further including loop material that is guided through the through-holes such that a first portion of the loop material forming a first loop is located on the first surface of the patch-shaped structure and a second portion of the loop material forming a second loop is also located on the first surface of the patch-shaped structure, the loop material of the first and second loops being fed through the through-holes such that a remainder of the loop material is located on the second surface of the patch-shaped structure between the patch-shaped structure and the container;

wherein the first loop and/or the second loop are extendable by pulling the respective first and/or second loop outward from the container, thereby pulling a portion of the remainder of the loop material through a through hole from the second surface to the first surface of the patch-shaped structure;

wherein, in an unpacked state of the container, the first loop and/or the second loop of the connecting means are extended from the patch-shaped structure and span at least a part of a circumference of the container, wherein, in the unpacked state of the container, the first loop and/or the second loop provide a handle suitable for being supported by a carrier to carry the container, and wherein the container has at least one edge and at least a portion of the container is detachable at the at least one edge, forming at least one detachable portion that, when detached, is adapted to engage with the first loop and/or the second loop of the connecting means to provide the handle.

2. The container of claim 1, wherein, in the unpacked state of the container, the at least one detachable portion of the container provides at least a part of the handle having a surface suitable for being supported by the carrier.

3. The container of claim 1, wherein the patch-shaped structure of the connecting means is attached to a sidewall of the container, and wherein, in the unpacked state of the container, the first loop and/or the second loop of the connecting means provides the handle in a location spaced apart from the container.

4. The container of claim 1, wherein, in the unpacked state of the container, the first loop and/or the second loop of the connecting means is adapted to wrap around the container.

5. The container of claim 1, wherein the loop material is a single piece of material forming a closed loop, and wherein either of the first loop or the second loop is retractable toward the container by pulling the respective other first or second loop.

6. The container of claim 1, wherein the patch-shaped structure is attached to at least one portion of the container by an adhesive.

7. The container of claim 1, wherein the loop material of the connecting means comprises at least one of: a string, a cord, a rope, a chain, a band or a belt.

8. The container of claim 1, fulfilling at least one of the following:

the container is a box; or the loop material of the connecting means comprises a string connected to the at least one detachable portion of the container and to the container.

9. The container of claim 1, wherein, in the unpacked state of the container, a larger portion of the loop material forming the first loop and/or the second loop of the connecting means is arranged on the outside of the patch-shaped structure compared to the portion of the loop material inside the patch-shaped structure between the patch-shaped structure and the container.

10. A system comprising:

a container, including a patch-shaped structure that has an outward-facing first surface and an inward-facing second surface opposite to the outward-facing first surface, wherein through-holes defined in the patch-shaped structure extend from the first surface to the second surface, and wherein a portion of the container external to the patch-shaped structure has additional through-holes defined therein extending from inside the container to outside the container, and loop material that is guided through the through-holes of the patch-shaped structure and the container such that a first portion of the loop material extends from the through-holes of the patch-shaped structure and forms a first loop that is located on the first surface of the patch-shaped structure and a second portion of the loop material extends from the through-holes of the container and forms a second loop that is located outside the container, the loop material of the first and second loops being fed through the through-holes such that a remainder of the loop material is located inside the container, wherein, in an unpacked state of the container, the first loop and/or the second loop are extended from the patch-shaped structure and/or the container respectively, and span at least a part of a circumference of the container, wherein, in the unpacked state of the container, the first loop and/or the second loop provide a handle suitable for being supported by a carrier to carry the container, and wherein the container has at least one edge, and at least a portion of the container is detachable at the at least one edge, forming at least one detachable portion that, when detached, is adapted to engage with the first loop and/or the second loop to provide the handle.

11. The system of claim 10, wherein, in the unpacked state of the container, the at least one detachable portion of the container provides at least a part of the handle having a surface suitable for being supported by the carrier of the container.

12. The system of claim 10, wherein the patch-shaped structure is detachable from the container, and wherein, in the unpacked state of the container, the patch-shaped structure is detached from the container and engages the first loop and/or the second loop to provide the handle in a location spaced apart from the container.

13. The system of claim 10, wherein, in the unpacked state of the container, the first loop and/or the second loop is adapted to wrap around the container.

14. A system comprising:

a patch-shaped structure having an outward-facing first surface and an inward-facing second surface opposite to the outward-facing first surface, wherein through-holes are defined in the patch-shaped structure and extend from the first surface to the second surface; and loop material that is guided through the through-holes such that a first portion of the loop material forming a first loop is located on the first surface of the patch-shaped structure and a second portion of the loop material forming a second loop is also located on the first surface of the patch-shaped structure, the loop material of the first and second loops being fed through the through-holes such that a remainder of the loop material is located on the second surface of the patch-shaped structure;

wherein the first loop and/or the second loop are extendable by pulling the respective first and/or second loop outward from the patch-shaped structure, thereby pulling a portion of the remainder of the loop material through a through hole from the second surface to the first surface of the patch-shaped structure, wherein the patch-shaped structure is attachable to a container, and when the patch-shaped structure is attached to the container, the remainder of the loop material located on the second surface of the patch-shaped structure is held between the patch-shaped structure and the container, and when the first loop and/or the second loop is extended from the patch-shaped structure, the first loop and/or the second loop is arranged to span at least a part of a circumference of the container and provide a handle suitable for being supported by a carrier to carry the container, and wherein a portion of the container is detachable from at least one edge of the container such that, when detached, the portion of the container is adapted to engage with the first loop and/or the second loop to provide the handle.

15. The system of claim 14, wherein the loop material is a single piece of material forming a closed loop, and when the patch-shaped structure is attached to the container, either of the first loop or the second loop is retractable toward the container by pulling the respective other first or second loop.

16. The system of claim 14, wherein the patch-shaped structure is attachable to at least one portion of the container by an adhesive.

17. The system of claim 14, wherein when the first loop and/or the second loop is extended from the patch-shaped structure, the first loop and/or the second loop is adapted to wrap around the container.

18. The system of claim 14, wherein when the first loop and/or the second loop is extended from the patch-shaped structure, a larger portion of the loop material forming the first loop and/or the second loop is arranged on the outward-facing first surface of the patch-shaped structure compared to the portion of the loop material on the inward-facing second surface of the patch-shaped structure.

* * * * *